United States Patent [19]

Kulke et al.

[11] 4,225,088

[45] Sep. 30, 1980

[54] FUEL INJECTION NOZZLE

[75] Inventors: Günter Kulke, Esslingen; Konrad Eckert, Stuttgart, both of Fed. Rep. of Germany

[73] Assignee: Robert Bosch GmbH, Stuttgart, Fed. Rep. of Germany

[21] Appl. No.: 886,311

[22] Filed: Mar. 13, 1978

[30] Foreign Application Priority Data

Mar. 16, 1977 [DE] Fed. Rep. of Germany ..... 2711391

[51] Int. Cl.[2] ..... F02M 45/00

[52] U.S. Cl. ..... 239/533.5; 239/533.8; 239/533.9; 239/563

[58] Field of Search ..... 239/533.3, 533.4, 533.5, 239/533.6, 533.7, 533.8, 533.9, 533.11, 533.12, 562, 563; 123/32 JV

[56] References Cited

U.S. PATENT DOCUMENTS

| | | | |
|---|---|---|---|
| 1,833,080 | 11/1931 | Kenworthy | 239/533.4 |
| 1,834,061 | 12/1931 | Joachim | 239/563 |
| 3,339,848 | 9/1967 | Geiger | 239/533.4 |
| 3,511,442 | 5/1970 | De Luca et al. | 239/533.3 |
| 3,831,863 | 8/1974 | Fenne | 239/533.8 |
| 4,071,197 | 1/1978 | Bailey et al. | 239/533.11 |

*Primary Examiner*—Robert B. Reeves
*Assistant Examiner*—Michael J. Forman
*Attorney, Agent, or Firm*—Edwin E. Greigg

[57] ABSTRACT

The invention relates to fuel injection nozzles for internal combustion engines provided with a nozzle body one end of which includes plural fuel injection spray apertures with plural telescopable valve needles slidably positioned in the nozzle body and arranged to control feed to the spray apertures. At least one valve needle is controllable by an adjusting piston subjected to fuel supply.

7 Claims, 5 Drawing Figures

FUEL INJECTION NOZZLE

BACKGROUND OF THE INVENTION

The invention relates to a fuel injection nozzle and more particularly to a fuel injection nozzle for internal combustion engines with a valve needle that is loaded in the closing direction. Such a valve needle slidably changes the cross section of the injection openings in dependence on the stroke thereof, i.e. the pressure of the fuel supplied for injection by sliding in the opening direction, and with an adjusting piston which is acted upon by a pressurized fluid and controls the stroke of the valve needle. In known fuel injection nozzles of this type, the adjusting piston comes into contact with the valve needle after a predetermined prior stroke thereof and acts thereon during the continued stroke. In this manner, first of all, it is not possible to hydraulically press the valve needle against the seat and to cause an opening thereof that is independent of the fuel supplied from the internal combustion engine, and secondly, the adjusting piston always begins its cooperation with the valve needle after the valve needle has completed a particular stroke. It is desirable, however, that the effect of the adjusting piston be arbitrary for a satisfactory formation of the injection principles, and also takes place primarily independently of the fuel supplied.

OBJECT AND SUMMARY OF THE INVENTION

The invention relates to a fuel injection nozzle whose valve needle can be controlled by an adjusting piston. The adjusting piston is non-hydraulically acted upon except for its effect on the valve needle.

The fuel injection nozzle according to the invention has the advantage that a greater degree of freedom is possible in the forming of the fuel injection spray into the internal combustion engine than that which is possible with the known nozzles. Especially with fuel injection nozzles having two valve needles, of which one is controlled by the adjusting piston, the injection openings that are controlled by the single valve needle can be opened or closed.

The principal object of the invention is to provide a fuel injection nozzle wherein an adjusting piston can be slid within the nozzle from its original position in the closing direction to limit the maximum cross section of the injection openings. The concept of this invention is not restricted to use with valve needles that open inwardly and have a valve seat, but can also be used on slide and pivot nozzles as well as outwardly opening valve needles.

Another object of the invention is to provide a fuel injection nozzle in which the adjusting piston limits the stroke of the valve needle so that it remains partially in the injection opening.

Still another object of the invention is to provide a telescoped valve needle construction each of which valve needles are acted upon by the fuel supply and can be moved away from their respective injection openings independently of the movement of an adjacent valve needle.

The invention will be better understood as well as further objects and advantages thereof become more apparent from the ensuing detailed description of two preferred embodiments taken in conjunction with the drawings.

DESCRIPTION OF THE PREFERRED EMBODIMENTS

Figure 1:
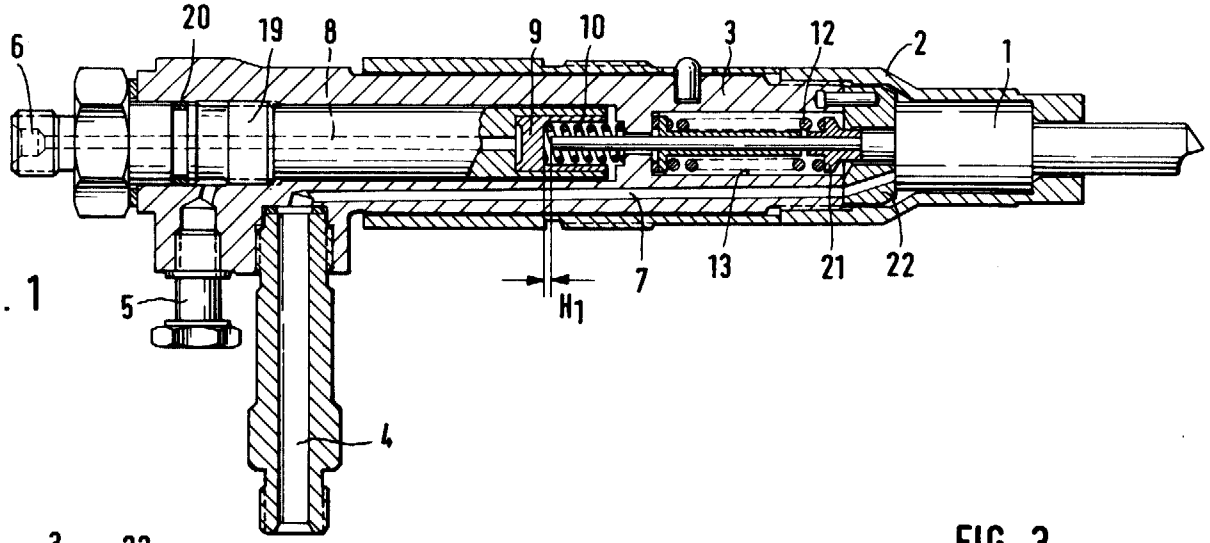
FIGS. 1–3 illustrate the first embodiment of this invention generally in cross section.

Turning now to the drawings, in both exemplary embodiments of the invention a nozzle body 1 is held secure against a nozzle holder 3 by a cap nut 2. A pressure connection 4, a return connection 5 and a control connection 6 are provided on the nozzle holder 3. The fuel supplied to the pressure connection 4 is fed through a pressure channel 7 that extends through the nozzle holder 3 and the nozzle body 1. The control fluid is fed to a reciprocable adjusting piston 9 through a channel 8 with the piston 9 being loaded by a spring 10 as clearly shown in FIG. 1.

When the piston 9 is not acted upon by the pressure of fluid, that is when it is in its initial inactive position, it has no controlling effect on the injection nozzle. By referring at this time to FIG. 4, it will be seen that the chamber 11,which contains spring 10 and the chamber 13 which contains the closing spring 12 of the valve needle, is relieved of pressure by means of the return connection 5.

Figure 2:
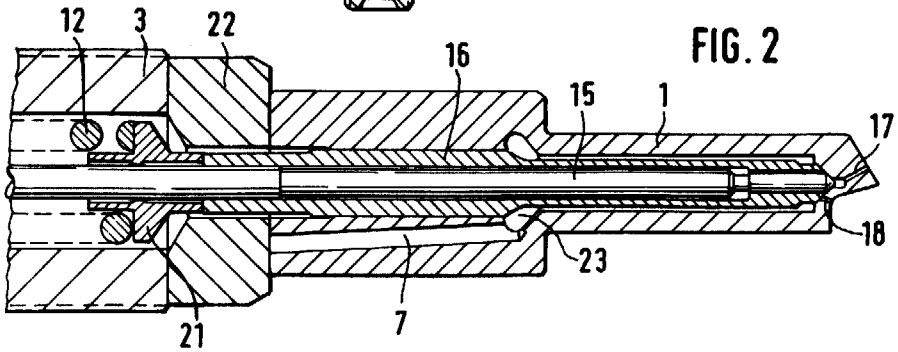
Figure 5:
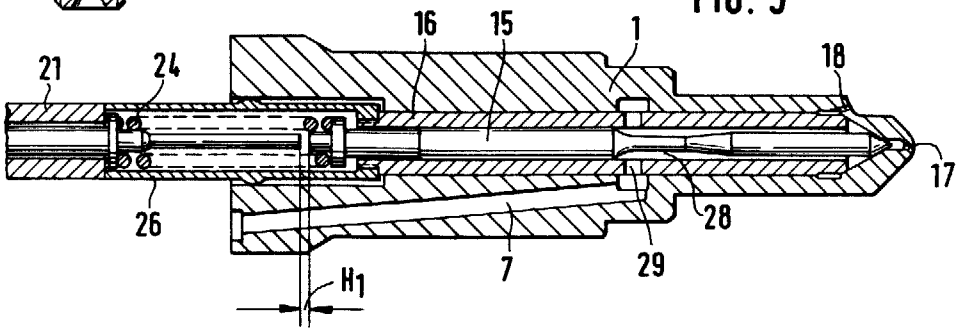

Also arranged in the nozzle body 1 is a valve needle 15 and this valve needle is telescoped by a hollow needle 16, these telescoped valve needles functioning together to control injection openings 17 and 18, respectively, all of which is clearly shown in FIGS. 2 and 5.

Figure 3:
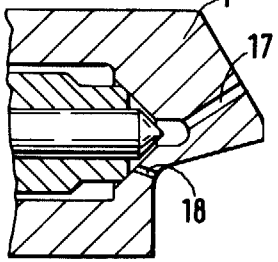

In the first exemplary embodiment of the invention shown in FIGS. 1 through 3, the valve needle 15 is not loaded by any special closing spring means. There is a predetermined distance provided for between the adjusting piston 9 and the end of the valve needle 15, which distance corresponds to the maximum stroke of the needle as illustrated at $H_1$. In addition, this stroke can be changed by the longitudinally apertured element 19 that includes an annular chamber into which the piston 9 is arranged to be received, it further being understood that the element 19 can be threaded into the nozzle body 11 from the outside thereof. The element 19 is further retained by a holder that includes an O-type seal ring 20 to thereby prevent loss of fuel to the outside.

Referring to FIG. 2, it will be noted that the hollow needle 16 is in abutting engagement with the axially apertured collar 21 that is loaded by means of the spring 12. Also the plate 22, mutually apertured as shown, is disposed between the nozzle body 1 and the nozzle holder 3 and this plate 22 further includes a perforated portion that communicates with the pressure channel 7. This is best shown in the right hand view of FIG. 1. Further, the pressure channel 7 terminates in a pressure chamber 23 (FIG. 2) that is provided for in the nozzle body 1. Thus when the hollow needle 16 is moved to the left, as viewed in the drawings, away from its seat, it opens the injection openings 18 so that an injection can take place therethrough. And, it is not until after this point in time is reached does fuel begin to act on the valve needle 15. (See FIG. 3) When the adjusting piston 9 is in the position shown in FIG. 1, it does not block the movement of the valve needle 15 away from its seat and thus the valve needle 15 is then shifted and can open the injection openings 17. Should, however, the adjusting piston 9 be pushed against the valve needle 15 by the aforementioned control pressure, then the entire injection cross section is limited to the cross section of the injection openings 18, which can result in an extended period of injection. It can also be desirable, however, to control the exact injection operation of the openings 17 and 18 with the valve needle 15 such as would be important for a preliminary injection. When the adjusting pistion 9 is not activated, the injection openings 17 and 18 are both opened almost simultaneously for an injection period.

Figure 4:
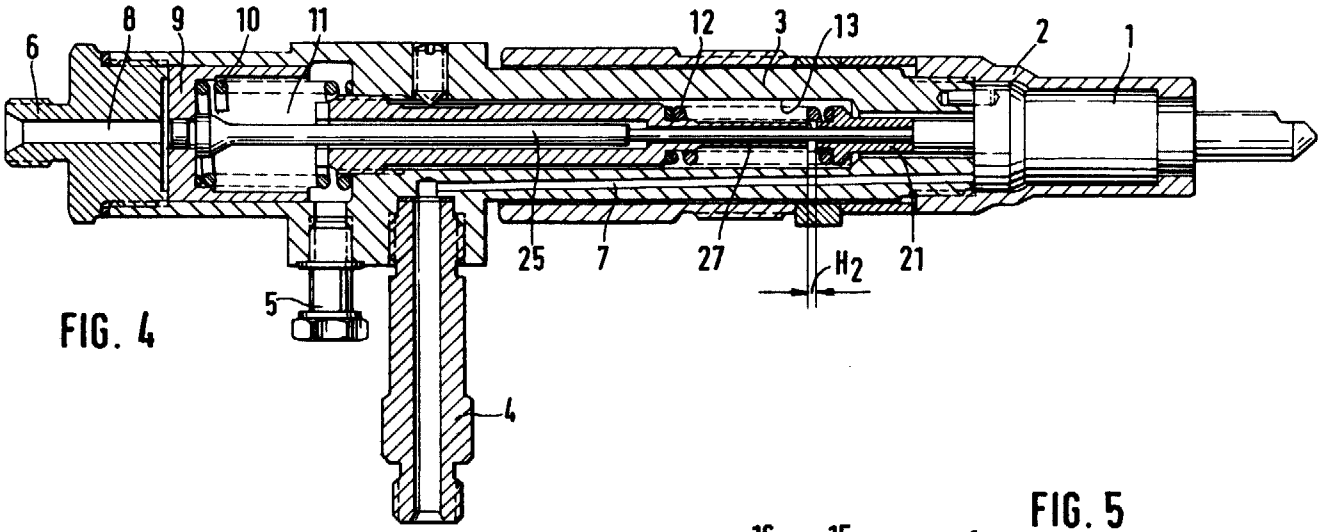
FIGS. 4–5 illustrate the second embodiment of this invention generally in cross section.

In the second exemplary embodiment of the invention shown in FIGS. 4 and 5, the valve needle 15 is loaded by a closing spring 24. A mandrel 25 is attached to the adjusting piston 9 and this mandrel serves as an operating connection to the valve needle 15. The mandrel 25 is loaded by the closing spring 24 which is associated with the valve needle 15. A sleeve-like bushing 26 that is disposed in abutment with the valve needle 15 serves to transfer forces from the hollow needle 16 to the spring plate 21 of the closing spring 12 that loads the hollow needle 16. The distance between the valve needle 15 and the mandrel 25 is the maximum stroke $H_1$. The maximum stroke $H_2$ of the hollow needle 16 is determined by the difference between the spring plate 21 and a stop 27 in whose central bore the mandrel 25 is guided. The fuel supply is fed through the pressure line 7 into a pressure chamber 28 that is provided between the valve needle 15 and the hollow needle 16. For this purpose, the radial bores 29 are provided in the hollow needle 16. Thus the fuel supply acts simultaneously in the direction of closing on the valve needle 15 and the hollow needle 16. Whether the valve 15 needle or the hollow needle is the first to open depends on which spring 12 or 24 is larger or smaller in relation to the surfaces of the valve needle that act in the direction of opening. This predetermined order of opening is also influenced by the adjusting piston 9. When control fluid is supplied to the piston 9 through the control connection 6 and the line 8 and the piston 9 is shifted longitudinally, the valve needle 15 is held against its valve seat. The fuel is thus only injected through the injection openings 18. If the hollow valve needle 16 usually opens before the valve needle 15, the injection cross section is only limited to the openings 18. If, however, the valve needle 15 usually opens before the hollow needle 16, then the control order can be reversed by the engagement of the adjusting piston 9. Thus, an injection can take place first through the injection openings 18, and then after the adjusting piston 9 has been relieved of pressure, through the injection openings 17, whereby the closing spring 24 of the valve needle 15 can push the valve needle back against its valve seat. Thus, it will be readily appreciated that the range of operation of this nozzle is therefore relatively large. A nozzle controlled in this manner can, on the one hand serve to provide a preliminary injection, to extend the injection period and the like, and on the other hand, can also serve as a reversing nozzle, in order to reverse and change from one series of injection holes (for example 17) to a different series of injection holes (for example 18), such as is necessary during the "M process" between a cold and warm engine.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines comprising, in combination, a nozzle holder, a nozzle body having a plurality of injection openings, conduit means for supplying pressurized fuel to said nozzle body, a valve needle slidably disposed in said nozzle body, means in said nozzle holder for urging said valve needle in one direction for closing engagement with said injection openings, said valve needle being slidably movable in the opposite valve opening direction throughout a stroke determined by the pressure of said pressurized fuel supplied by said supplying means to vary the cross-sectional flow area of said injection openings, an adjusting piston slidably disposed in said nozzle holder, a positioning spring in said nozzle holder engageable with said adjusting piston for urging said adjusting piston into said rest position in the opening direction of said valve needle, conduit means in said nozzle holder for applying a pressurized control fluid to said adjusting piston independent of pressurized fuel supplied to said nozzle body for controlling the stroke of said needle in said opposite valve opening direction, said adjusting piston being slidably movable by said control fluid from a rest position in said one direction for limiting the stroke of said valve needle and therefore the cross-sectional flow area of said injection openings.

2. A fuel injection nozzle according to claim 1, wherein said valve needle includes a throttle pin, said nozzle body injection openings including a central injection opening into which said throttle pin protrudes and a valve seat upstream of said central injection opening, said adjusting piston being arranged to limit said valve needle stroke in such a manner that said throttle pin remains at least partially in said central injection opening.

3. A fuel injection nozzle according to claim 1, wherein two of said valve needles are provided in said nozzle body and wherein both of said valve needles are slidably movable by said pressurized fuel in said opening direction, and wherein said injection openings include at least one injection opening controlled by the first of said valve needles and an injection opening separate from said at least one injection opening controlled by the second of said valve needles, valve seats in said nozzle body each associated with one of said first and second needles, said first and second valve needles being adapted to move independently of each other out of engagement with a respective valve seat and wherein one of said valve needles is adapted to cooperate with said adjusting piston.

4. A fuel injection nozzle according to claim 3, wherein said pressurized control fluid comprises said pressurized fuel and said one valve needle is adapted to be pressed against its respective valve seat by said adjusting piston acted upon by said pressurized fuel opposite said opening direction whereby said injection opening controlled by said one valve needle is blocked.

5. A fuel injection nozzle according to claim 3, including a pressure chamber in said nozzle body associated with said first valve needle, a pressure chamber in said nozzle body associated with said second valve needle, and wherein said means for supplying pressurized fluid to said nozzle body includes means for supplying pressurized fluid to said pressure chambers in which fuel is first supplied to said first valve needle pressure chamber and is prevented from entering said second valve needle pressure chamber until said first valve needle lifts from its valve seat.

6. A fuel injection nozzle according to claim 5, including a spring in said nozzle holder for moving said second needle in said closing direction to close its associated injection opening during normal operation, said second needle being movable in the closing direction for closing its associated injection opening by said adjusting piston when said control fluid is applied to said adjusting piston.

7. A fuel injection nozzle according to claim 3 wherein said two needles comprise a hollow needle having a bore and a valve needle slidably guided in said hollow needle bore.

* * * * *